US009506207B2

(12) United States Patent
Nishida

(10) Patent No.: US 9,506,207 B2
(45) Date of Patent: Nov. 29, 2016

(54) SURFACE GRINDING DEVICE OF PAVEMENT SURFACE

(71) Applicant: HEAT ROCK KOHGYO CO. LTD., Tokyo (JP)

(72) Inventor: Hiroyuki Nishida, Niigata (JP)

(73) Assignee: HEAT ROCK KOHGYO CO., LTD., Tokyo (JP)

( * ) Notice: Subject to any disclaimer, the term of this patent is extended or adjusted under 35 U.S.C. 154(b) by 8 days.

(21) Appl. No.: 14/385,560

(22) PCT Filed: May 16, 2014

(86) PCT No.: PCT/JP2014/002578
§ 371 (c)(1),
(2) Date: Sep. 16, 2014

(87) PCT Pub. No.: WO2015/011862
PCT Pub. Date: Jan. 29, 2015

(65) Prior Publication Data

US 2016/0237631 A1 Aug. 18, 2016

(30) Foreign Application Priority Data

Jul. 23, 2013 (JP) ..... 2013-152279

(51) Int. Cl.
*E01C 23/088* (2006.01)
*E01C 23/12* (2006.01)

(52) U.S. Cl.
CPC ..... *E01C 23/088* (2013.01); *E01C 23/127* (2013.01)

(58) Field of Classification Search
CPC ..... E01C 23/088; E01C 23/12
See application file for complete search history.

(56) References Cited

U.S. PATENT DOCUMENTS 3,585,761 A * 6/1971 Hughes ..... B27B 5/34 451/544

FOREIGN PATENT DOCUMENTS

EP 1426156 A1 * 6/2004 ..... B28D 1/181
JP 2007-284900 A 11/2007

OTHER PUBLICATIONS

Extended European search report issued in corresponding European patent application No. 14829123.0 on Mar. 18, 2016.

* cited by examiner

*Primary Examiner* — John Kreck
(74) *Attorney, Agent, or Firm* — Kratz, Quintos & Hanson, LLP

(57) ABSTRACT

The present invention provides a surface grinding device of a pavement surface in which driving energy is small, the device can be used for long periods of time, and it is possible to smoothly grind a surface of the pavement surface without damaging the pavement surface. A grinding body (6) of a surface grinding device (1) of a pavement surface is composed of a rotation shaft (13) and several blades (14). Each of the blades (14) includes a substantially rectangular plate (15) having a predetermined thickness, and arc grinding pieces (16) provided on edges of both short sides of the plate (15). A shaft hole (18) is formed in a center of the plate (15), and the rotation shaft (13) is inserted into the shaft hole (18).

2 Claims, 5 Drawing Sheets

FIG. 3(A)
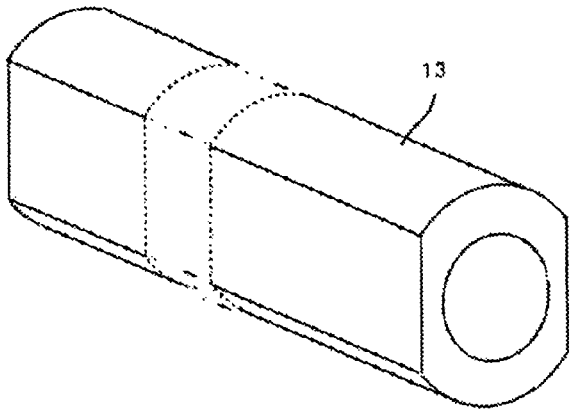
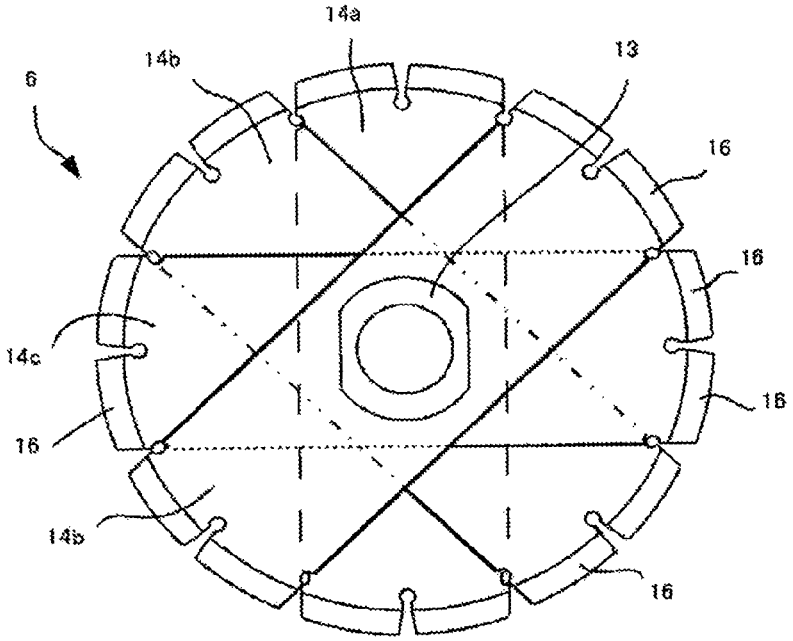
FIG. 3(B)

FIG. 4(A)
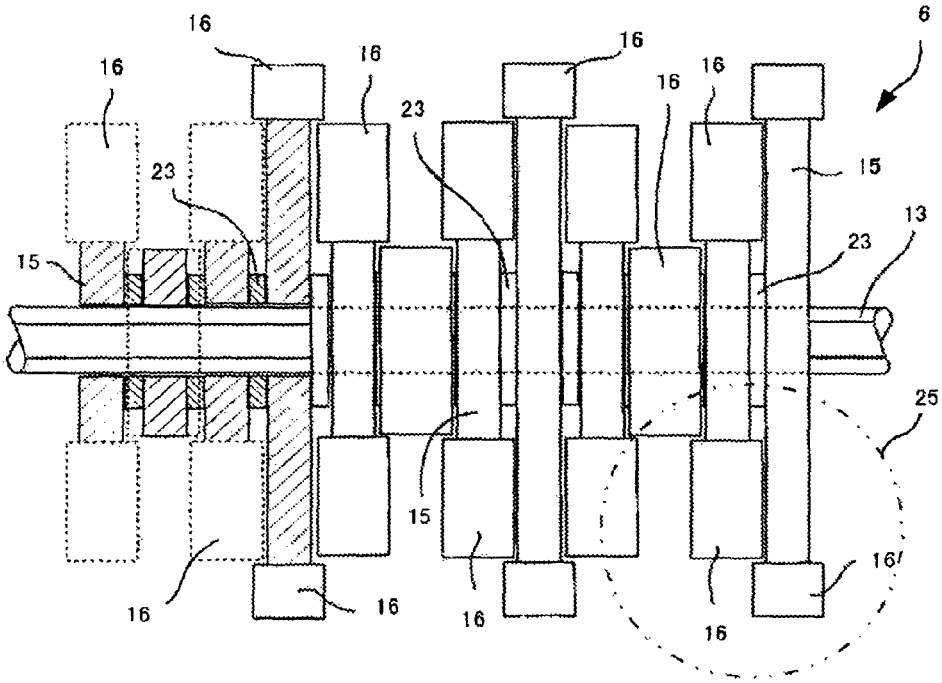
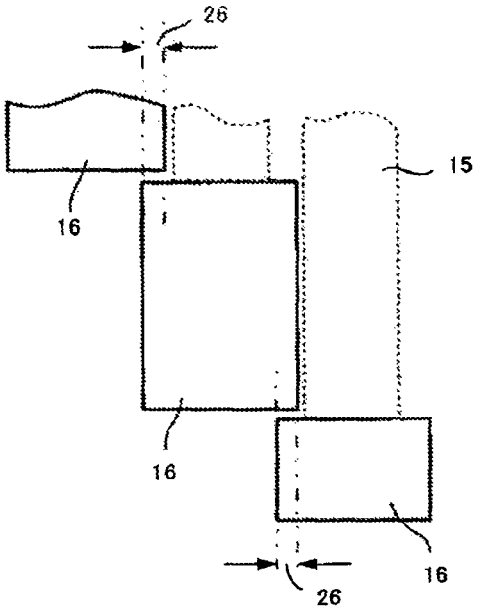
FIG. 4(B)
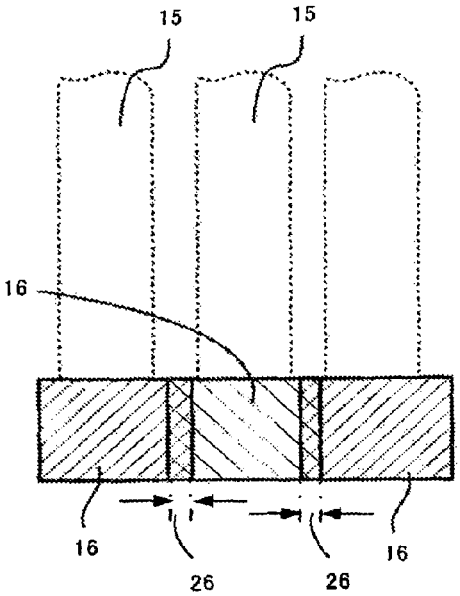
FIG. 4(C)

FIG. 5
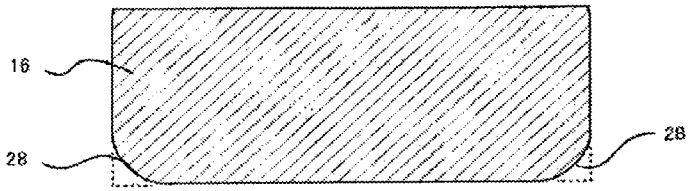
FIG. 6(A)
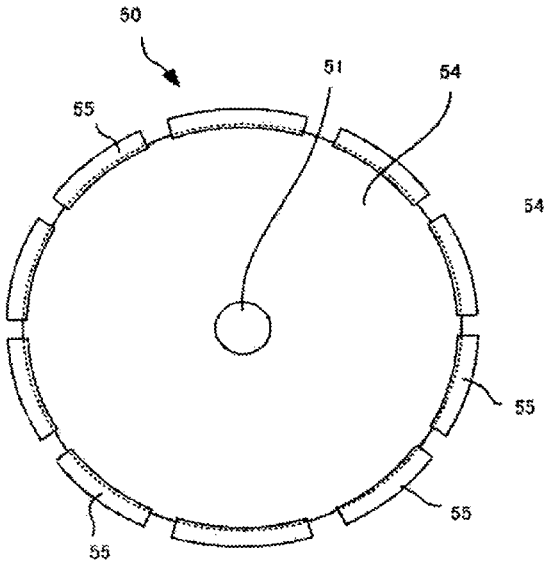
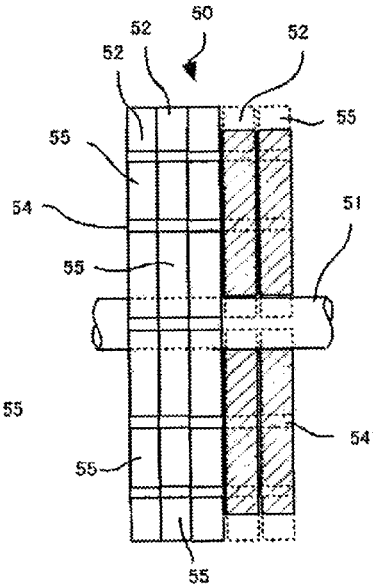
FIG. 6(B)
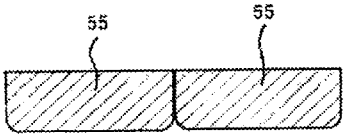
FIG. 6(C)

SURFACE GRINDING DEVICE OF PAVEMENT SURFACE

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM (EFS-WEB)

Not Applicable

STATEMENT REGARDING PRIOR DISCLOSURES BY THE INVENTOR OR A JOINT INVENTOR

Not Applicable

BACKGROUND OF THE INVENTION

Field of the Invention

The present invention relates to a surface grinding device of a pavement surface which is used for repairing a deteriorated pavement surface and which grinds a surface of the pavement surface.

A pavement surface which is paved by asphalt-mixed material enhances endurance of a road and provides comfortable traveling performance. However, a surface of the pavement surface is deteriorated or worn when the pavement surface is used for long periods of time. Wheel tracks are formed in the pavement surface and flatness thereof is deteriorated. Therefore, it is necessary to appropriately repair the pavement surface. If a pavement surface is deteriorated or worn, it is necessary to entirely repair the pavement surface. In this case, an entire surface of the pavement surface is shallowly shaved off, and deteriorated asphalt-mixed material is removed. Then, the pavement surface is repaved using new asphalt-mixed material thereon. When a relatively simple repairing operation is carried out for recovering flatness of a portion of a pavement surface, portions thereof which are raised in a convex form are shaved off into flat surfaces, and concaved portions of the pavement surface are filled with new asphalt-mixed material. In this specification, the former repairing operation is called an entire pavement surface repairing operation, and the later repairing operation is called a partial pavement surface repairing operation.

Description of Related Art

Patent Documents

[Patent Document 1] JP 9-41319 A
[Patent Document 2] JP 2007-284900 A

In the entire pavement surface repairing operation, a road surface cutting device for shaving off deteriorated asphalt-mixed material of a surface of a pavement surface is known, and this road surface cutting device is described in Patent Document 1 for example. The road surface cutting device described in Patent Document 1 includes a rotating drum which is rotated and driven, and a plurality of cutter bits provided on a surface of the rotating drum. A tip end of each of the cutter bits is a pawl-shaped metal piece. Therefore, if the rotating drum is rotated while moving the road surface cutting device at low speed, the plurality of cutter bits can scratch a pavement surface and can shave off a deteriorated surface thereof. A shaved surface which is shaved off by the road surface cutting device described in Patent Document 1 becomes an indented surface which is scratched up in streaked form.

In the entire pavement surface repairing operation, there is also a known device which shaves off a pavement surface such that its surface is polished in a predetermined width. A portion of this device which polishes a pavement surface has a columnar grinder-shape, and this device can be called a road surface cutting device but since a surface obtained by grinding a pavement surface like a grinder is a smooth surface, this device can also be called a road surface grinding device. This road surface grinding device includes a columnar grinder-shaped grinding body 50 as shown in FIGS. 6(A) and 6(B). This grinding body 50 includes a rotation shaft 51 and a plurality of blades 52, 52, . . . provided on the rotation shaft 51. One blade 51 includes a steel disk 54 having a predetermined thickness, and grinding pieces 55, 55, . . . provided on an outer periphery of the disk 54 at equal distances from one another in its circumferential direction. Each of the grinding pieces 55, 55, . . . is made of sintered material in which diamond grain is kneaded, and is formed into an arc small piece having a predetermined length. A width, i.e., a thickness of the grinding piece 55 is substantially the same as a thickness of the disk 54. Since the plurality of blades 52, 52, . . . are provided on the rotation shaft 51, the grinding body 50 has a columnar grinder-shape as a whole. If such a grinding body 50 hits a pavement surface and is rotated, the grinding body 50 can smoothly shave off or grind a surface of the pavement surface, and an obtained surface of the pavement surface is smooth.

Although Patent Document 2 does not have a direct relationship with the present invention, it is described in Patent Document 2 that before a white center line (center line or line mark) is applied onto a pavement surface, a portion of the pavement surface which corresponds to the white center line is cut to a predetermined depth. This line groove cutting device also shaves off a pavement surface such that it is grinded, and a grinding body of the device has a shape similar to that of the grinding body 50 shown in FIG. 6. That is, the grinding body includes a rotation shaft and a plurality of blades provided on the rotation shaft, and each of the blades includes a disk having a predetermined thickness and grinding pieces provided on an outer peripheral surface of the disk at equal distances from one another in its circumferential direction. In the grinding body described in Patent Document 2, however, the plurality of grinding pieces provided on one blade are provided in the circumferential direction at distances corresponding to one grinding piece from one another, and a width, i.e., a thickness of the grinding piece is greater than a thickness of the disk. When the grinding body is assembled from the plurality of blades, the adjacent blades are deviated from each other in a rotation direction so that grinding piece provided on the blades do not interfere with each other. Since the grinding body is formed in this manner, when the grinding body is rotated to shave off a pavement surface, a width of the pavement surface which is shaved off by one of the blades and a width of the pavement surface which is shaved off by another blade are overlapped with each other by a predetermined overlap space. After a pavement surface is cut or grinded to a predetermined depth and a line groove is formed by the device described in Patent Document 2, if paint is applied to the line groove to draw a white center line, the white center line is formed at the same height as the pavement surface.

BRIEF SUMMARY OF THE INVENTION

Problem to be Solved by the Invention

According to the road surface cutting device described in Patent Document 1 also, and according to the above-described conventional road surface grinding device also, it is possible to remove deteriorated asphalt-mixed material on a surface of a pavement surface in the entire pavement surface repairing operation and then, the pavement surface can be repaved by new asphalt-mixed material. However, there are the following problems. If a surface of a pavement surface is cut by the road surface cutting device described in Patent Document 1, the surface becomes an indented surface which is scratched up in streaked form. According to this, adhesion properties with respect to the new asphalt-mixed material are deteriorated and after the pavement surface is repaved, the new asphalt-mixed material easily separates from the oil asphalt-mixed material. Further, when the surface of the pavement surface is cut, since the surface is cut such that it is scratched, there is a problem that the pavement surface is damaged. When a pavement surface is partially repaired also, the road surface cutting device described in Patent Document 1 can not be utilized because the scratched up mark is formed in streaked form. If the road surface grinding device having the grinding body 50 as shown in FIG. 6 is used, these problems are solved to a certain degree. That is, since a pavement surface can be grinded smoothly, new asphalt-mixed material which is paved again is strongly adhered to old asphalt-mixed material, and the pavement surface is not damaged at the time of the grinding operation. Further, in the partial pavement surface repairing operation also, since portions of the pavement surface which are raised in a convex form can smoothly be grinded, there is no problem. However, if this conventional road surface grinding device is used for long periods of time, angle portions of the grinding pieces 55, 55, . . . are worn as shown in FIG. 6(C). In this case, if a pavement surface is grinded, these worn portions become gaps and streaked shapes are formed on the grinded surface. There are also other problems. That is, since the grinding body 50 is formed into the columnar shape as a whole by overlapping the disk-shaped blades 52, 52, . . . with one another, there is no gap inside the columnar. Therefore, the grinding body 50 is extremely heavy. Hence, energy is required for driving the grinding body 50, and weight applied to a pavement surface becomes excessively heavy at the time of the grinding operation, and influence is exerted on the pavement surface. When a pavement surface is grinded, friction heat is generated. Since there is no gap in the columnar of the grinding body 50, the friction heat is not dissipated, the heat stays inside and temperature of the grinding pieces 55, 55, . . . rises. As a result, the grinding pieces 55, 50 . . . are prone to be deteriorated.

The line groove cutting device described in Patent Document 2 is not designed for the purpose of repairing a pavement surface, but a case where this line groove cutting device is used for repairing the pavement surface will be discussed here. In the case of the device described in Patent Document 2, when the grinding body is rotated to shave off a pavement surface, a width of the pavement surface which is shaved off by one of the blades and a width of the pavement surface which is shaved off by another blade are overlapped with each other by a predetermined overlap space. According to this, even if the device is used for long periods of time and the blades are worn, a streak is not formed in the grinded pavement surface, and it is guaranteed that the surface becomes smooth. However, the grinding body of the device described in Patent Document 2 is also formed by closely overlapping the plurality of disk-shaped blades with one another and therefore, there is no gap inside the grinding body. Hence, this device also has the same problem as that of the above-described conventional road surface grinding device including the grinding body 50. That is, since the weight of the grinding body is heavy, energy is required for driving the grinding body, and the weight exerts influence on a pavement surface. Further, friction heat is less prone to be dissipated, and the blades are prone to be deteriorated. The line groove has a relatively small area to be grinded in the first place (even if its line is thick), but as long as such a line groove is grinded, influence of these problems does not appear almost at all, but when a pavement surface is grinded over a wide range, the influence of these problems becomes serious. That is, the line groove cutting device described in Patent Document 2 can not be utilized for repairing a pavement surface.

It is an object of the present invention to provide a surface grinding device of a pavement surface which solves the above-described problems. That is, it is an object of the invention to provide a surface grinding device of a pavement surface in which energy required for driving the surface grinding device is small, the device can stably be used for long periods of time, and it is possible to smoothly grind a surface of the pavement surface without damaging the pavement surface.

Means for Solving the Problems

To achieve the above objects, the present invention provides a surface grinding device of a pavement surface including a predetermined grinding body in which when the pavement surface is repaired, a surface thereof is grinded to remove deteriorated asphalt-mixed material. The grinding body is composed of a rotation shaft and a plurality of blades provided on the rotation shaft. Each of the blades is composed of a substantially rectangular plate having a predetermined thickness, and arc grinding pieces provided on edges of both short sides of the plate. A shaft hole is formed in a center of the plate, and the rotation shaft is inserted into the shaft hole. In the grinding body, the plurality of blades are deviated from and overlapped with one another in a rotation direction of the grinding body so that grinding pieces of adjacent blades do not interfere with each other. A thickness of the grinding piece is thicker than that of the plate. According to this, when the grinding body rotates and grinds a surface of a pavement surface, widths of the pavement surface grinded by the grinding pieces of adjacent blades overlap with each other by a predetermined overlap space.

To achieve the above objects, the invention described in claim 1 provides a surface grinding device of a pavement surface for grinding a surface of the pavement surface by a rotating grinding body, wherein the grinding body comprises a rotation shaft, and a plurality of blades provided on the rotation shaft, each of the blades includes a substantially rectangular plate having a predetermined thickness, and arc grinding pieces provided on edges of both short sides of the rectangular plate, a shaft hole is formed in a center of the blade, and the rotation shaft is inserted into the shaft hole, the plurality of blades in the grinding body are deviated from and overlap with one another in a rotation direction of the grinding body such that the grinding pieces respectively provided on the adjacent blades are deviated from one another in the rotation direction, a width of the grinding piece is greater than a thickness of the plate and according to this configuration, when the grinding body rotates to grind a surface of the pavement surface, widths of the surface grinded by the grinding pieces of the adjacent blades overlap with each other by a predetermined overlap space.

According to the invention described in claim 2, in the surface grinding device described in claim 1, each of the grinding pieces is formed by sintering from metal material including diamond grain.

Effect of the Invention

As described above, the present invention provides a surface grinding device of a pavement surface for grinding a surface of the pavement surface by a rotating grinding body, the grinding body comprises a rotation shaft, and a plurality of blades provided on the rotation shaft, each of the blades includes a substantially rectangular plate having a predetermined thickness, and arc grinding pieces provided on edges of both short sides of the rectangular plate, a shaft hole is formed in a center of the blade, and the rotation shaft is inserted into the shaft hole, the plurality of blades in the grinding body are deviated from and overlap with one another in a rotation direction of the grinding body such that the grinding pieces respectively provided on the adjacent blades are deviated from one another in the rotation direction. Therefore, the grinding body has many gaps, and a weight of the grinding body is light as a whole. Since the weight of the grinding body is light, energy for driving the grinding body may be small, and a heavy weight is not applied to a pavement surface which is grinded and thus, influence is not exerted on the pavement surface. Since the grinding body has many gaps, other effects can also be obtained. First, there is an effect that friction heat generated when a pavement surface is grinded can easily be dissipated, it is possible to prevent the grinding piece from being heated to excessively high temperature, and the grinding piece is less prone to be deteriorated. Next, there is an effect that dust can easily be sucked. That is, a surface cutting device is provided with a suction device which sucks dust generated by the grinding operation, and its suction port is provided in an upper portion of the grinding body. If almost no gap exists in the grinding body, dust is discharged mainly rearward of the grinding body and then, dust is sucked into the upper suction port. However, since the grinding body of the invention has many gaps, dust is sucked directly upward through the gaps, and is sucked from the suction port. That is, a suction effect is high. Further, there is also an effect that predetermined liquid which is sprayed when a pavement surface is grinded is easily dispersed. That is, in the surface grinding device, a pavement surface is grinded while spraying predetermined liquid mainly including water so that blades are not excessively heated and grinded dust does not again adhere to the pavement surface. Since the grinding body of the invention has many gaps, sprayed liquid passes through the gaps and is dispersed appropriately. That is, such a dispersion effect of liquid is high. According to the invention, a width of the grinding piece is greater than a thickness of the plate and according to this configuration, when the grinding body rotates to grind a surface of the pavement surface, widths of the surface grinded by the grinding pieces of the adjacent blades overlap with each other by a predetermined overlap space. Therefore, it is guaranteed that a grinded surface is smooth for long periods of time. That is, even if grinding pieces are worn and angle portions thereof are rounded due to usage for long periods of time, since the grinding widths overlap with one another by the overlap space, streaks are not formed in the grinded surface. According to another invention, each of the grinding pieces is formed by sintering from metal material including diamond grain. Since hardness of diamond is high and the diamond is not worn easily, there is an effect that the grinding pieces are not deteriorated easily.

BRIEF DESCRIPTION OF THE SEVERAL VIEWS OF THE DRAWINGS

FIG. 2 are diagrams showing blades configuring a grinding body according to the embodiment of the invention, wherein

FIG. 3 show the grinding body according to the embodiment of the invention, wherein FIG. 3(A) is a perspective view of a rotation shaft which configures the grinding body, and FIG. 3(B) is a side view of the grinding body.

FIG. 4 are diagrams showing the grinding body according to the embodiment of the invention, wherein FIG. 4(A) is a partially sectional front view of the grinding body, FIG. 4(B) is a front view showing a portion of the grinding body, and FIG. 4(C) is a front view showing a portion of the grinding body in a state where the grinding body rotates;

FIG. 5 is a sectional view of a grinding piece showing a state where the grinding piece of the grinding body according to the embodiment of the invention is worn; and FIG. 6 are diagrams showing a grinding body of a conventional road surface grinding device, wherein FIGS. 6(A) and 6(B) are a side view and a front view of the grinding body, and FIG. 6(C) is a sectional view of the grinding pieces showing a state where the grinding pieces provided on the grinding body are worn.

DETAILED DESCRIPTION OF THE INVENTION

Figure 1:
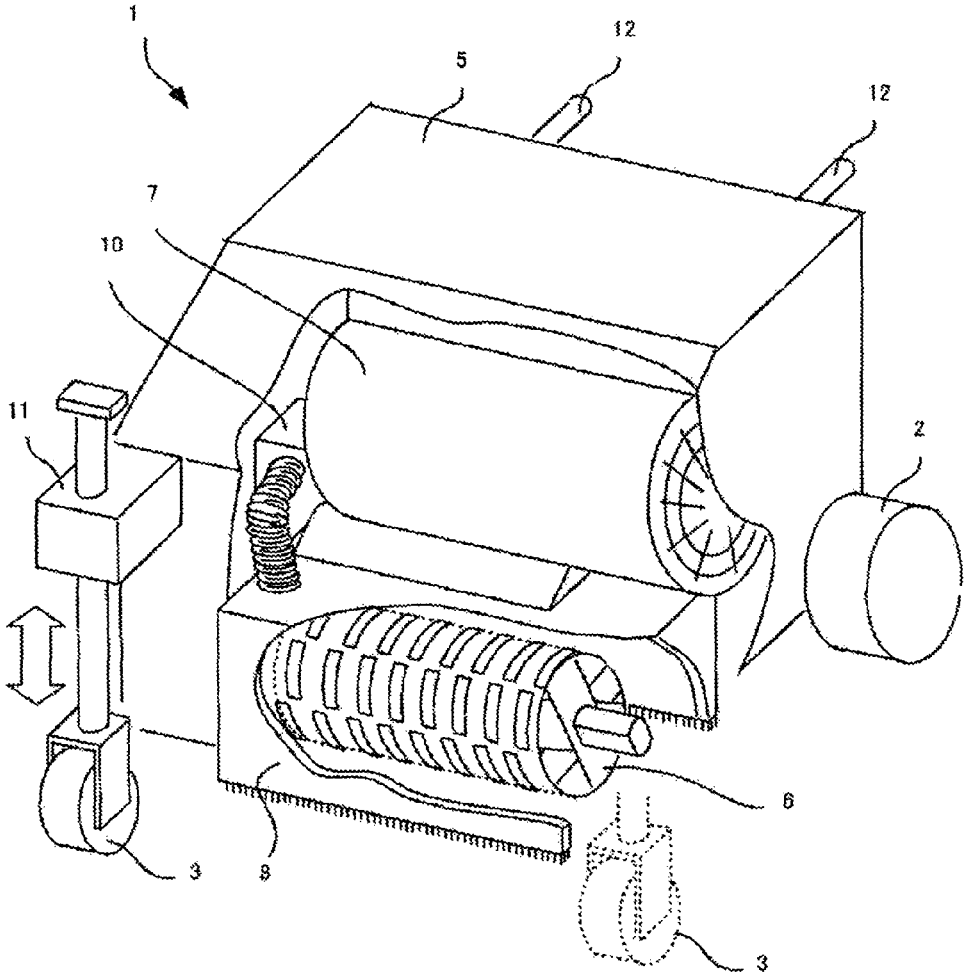
FIG. 1 is a schematic perspective view of a surface grinding device of a pavement surface according to an embodiment of the present invention.
Figure 2A:
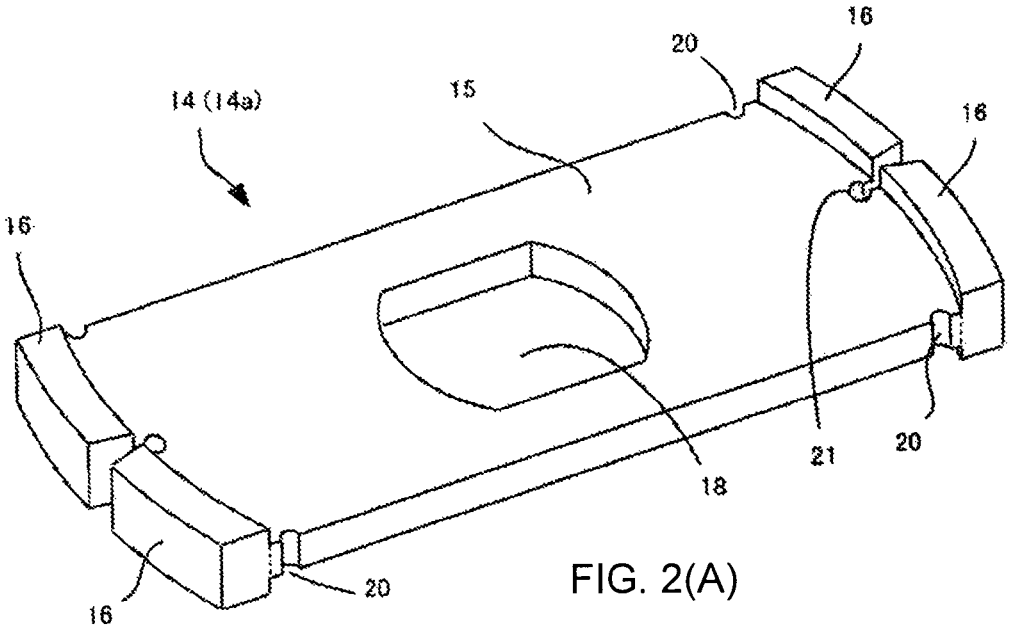
FIGS. 2(A) and 2(B) are a perspective view and a plan view of a first kind of blade.
Figure 2B:
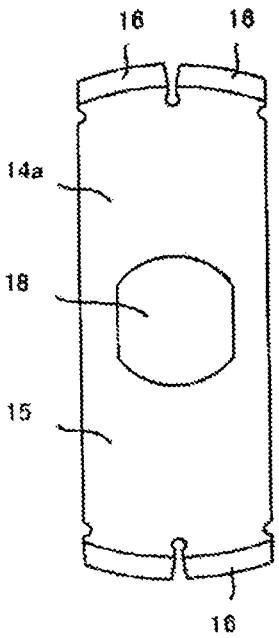
Figure 2C:
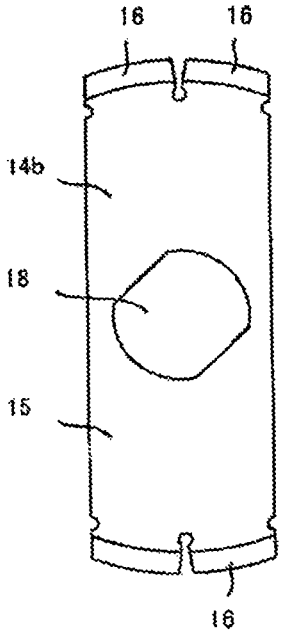
FIGS. 2(C) and 2(D) are plan views of second and third kinds of blades.
Figure 2D:
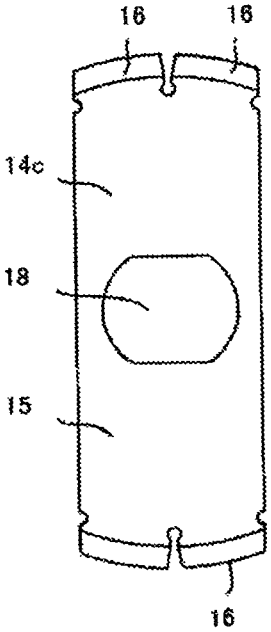

An embodiment will be described below. As schematically shown in FIG. 1, a surface grinding device 1 of a pavement surface according to the embodiment is composed of a vehicle 5 which runs by means of wheels 2, 3, . . . , a grinding body 6 according to the embodiment of the present invention for grinding the pavement surface, a motor 7 for rotating the grinding body 6, a dust-proof cover 8 which surrounds the grinding body 6 for preventing dispersion of dust which generates when the pavement surface is grinded, and a dust collecting device 10 for sucking and collecting dust. Positions of the rear wheels 2 and 2 of the vehicle 5 are fixed, but heights of the front wheels 3 and 3 can be changed by a height-adjusting mechanism 11. The grinding body 6 will be described in detail. A position of the grinding body 6 is fixed to the vehicle 5, but if the heights of the front wheels 3 and 3 are changed by adjusting the height-adjusting mechanism 11, the height of the grinding body 6 with respect to the pavement surface is changed, and a grinding depth of the pavement surface can be adjusted. In the embodiment, handles 12 and 12 are provided on a rear portion of the vehicle 5, operation switches are provided on the handles 12 and 12, an operator operates the handles 12 and 12 in his or her standing state and can operate the surface grinding device 1. Although the grinding body 6 is rotated by the motor 7 which is electrically driven in this embodiment, the grinding body 6 may be driven by an engine.

The grinding body 6 of the embodiment includes a rotation shaft 13 shown in FIG. 3(A), and a plurality of blades 14 shown in FIG. 2 are formed on the rotation shaft 13 such that the blades 14 overlap with one another. As shown in FIGS. 2(A) and 2(B), each of the blades 14 includes a substantially rectangular steel plate 15 having a predetermined thickness, and grinding pieces 16, 16, . . . provided on both short sides of the rectangular plate 15. A shaft hole 18 is formed in a center of the plate 15 and the rotation shaft 13 is inserted into the shaft hole 18. As shown in FIG. 3(A), the rotation shaft 13 is formed by cutting off one and the other side surfaces of a columnar body, and a cross section of the rotation shaft 13 has a vertically long circle whose both sides are cut off. By forming the cross section of the rotation shaft 13 into the non-circular shape in this manner, a rotation force is transmitted without loss like a so-called keyed rotation shaft (rotation shaft having key). The shaft holes 18 of the plates 15 have the same shapes so that the rotation shaft 13 is engaged with the shaft holes 18, but directions of the shaft holes 18 are different from one another depending upon the blades 14. That is, in a first kind of blade 14*a* shown in FIG. 2(A), a vertically long direction of the shaft hole 18 matches with a vertically long direction of the plate 15. In a second kind of blade 14*b*, a vertically long direction of the shaft hole 18 rotates 45° as shown in FIG. 2(C). In a third kind of blade 14*c*, a vertically long direction of the shaft hole 18 rotates 90° as shown in FIG. 2(D). Since the shaft holes 18, 18, . . . are deviated from each other in the rotation direction in this manner, the rotation shaft 13 can be inserted into the shaft holes 18, 18, . . . in a state where the blades 14*a*, 14*b* and 14*c* are deviated from one another in the rotation direction. This embodiment has only three kinds of blades, i.e., the blades 14*a*, 14*b* and 14*c*, and the shaft hole 18 does not rotate 135° with respect to the first kind of blade 14*a*, but if the second kind of blade 14*b* is turned upside down, this second kind of blade 14*b* corresponds to a blade whose shaft hole 18 rotates 135°.

Each of the grinding pieces 16, 16, . . . is formed by sintering from sintered material in which diamond grain is kneaded, and the grinding piece 16 has a curved rectangular parallelepiped shape. Since the grinding piece 16 is curved, the grinding piece 16 configures an arc of a circle centering on the shaft hole 18. According to this, outer surfaces of the grinding pieces 16, 16, . . . configure a portion of a columnar surface of a columnar centering on the shaft hole 18 as a center axis. Widths or thicknesses of the grinding pieces 16, 16, . . . are greater than a thickness of the plate 15. According to this, when the grinding body 6 formed by overlapping the blades 14 with one another grinds a pavement surface, it is guaranteed the grinded surface becomes smooth as will be described later. In this embodiment, four grinding pieces 16, 16, . . . are provided on one blade 14, i.e., two grinding pieces 16 are provided on one of short sides, and two grinding pieces 16 are provided on the other short side, but only if the grinding pieces 16, 16, . . . are provided on the short sides of the blade 14, the number of grinding pieces 16, 16, . . . is not limited. In this embodiment, since one gap is formed in this manner, the number of grinding pieces 16 provided on one of short sides in which one gap is formed is two. The grinding pieces 16, 16, . . . are welded to the plate 15, and notches 20, 21, . . . are formed in connected portion of the plate 15.

The grinding body 6 of the embodiment is assembled in such a manner that the rotation shaft 13 shown in FIG. 3(A) is sequentially inserted into the first to third kinds of blades 14*a*, 14*b* and 14*c* such that the blades overlap with one another. That is, as shown in FIG. 3(B), the rotation shaft 13 is inserted into the first kind of blade 14*a* and then, into the second kind of blade 14*b* and then, into the third kind of blade 14*c*. Next, the second kind of blade 14*b* is turned upside down, and the rotation shaft 13 is inserted into the second kind of blade 14*b*. FIG. 3(B) shows this state as viewed from side, i.e., as viewed from an axial direction of the rotation shaft 13. If the rotation shaft 13 is inserted into the four blades 14*a*, 14*b*, . . . in this manner, the plurality of grinding pieces 16, 16, . . . are placed on a circumference at equal distances from one another. The grinding pieces 16, 16, . . . belonging to adjacent blades 14 are deviated from each other in the rotation direction. Therefore, even if the thicknesses of the grinding pieces 16, 16, . . . are greater than the thickness of the plate 15, they do not interfere with each other. If the rotation shaft 13 is inserted into the first to third kinds of blades 14*a*, 14*b* and 14*c* continuously, the grinding body 6 is obtained. Thin plate spacers may be placed between any of blades 14 when the rotation shaft 13 is inserted into the blades 14.

FIG. 4(A) shows the assembled grinding body 6 as viewed from front. In this example, thin plate spacers 23, 23 . . . are inserted between adjacent blades 14, 14, . . . . FIG. 4(B) is an enlarged diagram of a portion 25 shown in FIG. 4(A). The grinding pieces 16, 16, . . . respectively provided on the adjacent blades 14, 14, . . . overlap with one another by a predetermined width 26. According to this, when the grinding body 6 is rotated to grind a pavement surface, a grinding width grinded by the grinding pieces 16, 16, . . . of any blade 14 and a grinding width grinded by the grinding pieces 16, 16, . . . of one of the blades 14 which is adjacent to the former blade 14 overlap with each other by the overlap space 26 as shown in FIG. 4(C).

Action of the surface grinding device 1 of a pavement surface according to the embodiment including the grinding body 6 according to the embodiment will be described. The surface grinding device 1 of the embodiment grinds a pavement surface having a deteriorated surface in the following manner. Heights of the front wheels 2 are adjusted by the height-adjusting mechanism 11 so that the grinding body 6 hits the pavement surface. In this state, the grinding body 6 is rotated by the motor 7. According to this, a surface of the pavement surface is grinded to a predetermined depth. If the vehicle 5 is moved at given speed, the pavement surface can be grinded with a width of the grinding body 6. At this time, the grinding widths grinded by the grinding pieces 16, 16, . . . respectively provided on the adjacent blades 14, 14, . . . of the grinding body 6 overlap with one another by the overlap space 26 as described above, streaks are not formed in the obtained grinded surface and the grinded surface is smooth. The surface grinding device 1 is moved and the pavement surface is grinded over its entire surface. According to this, it is possible to remove deteriorated asphalt-mixed material. Thereafter, if the pavement surface is repaved using new asphalt-mixed material, the repairing operation of the pavement surface is completed.

If the grinding body 6 according to the embodiment is used for long periods of time, angle portions 28 and 28 are worn and rounded as shown in FIG. 5. According to the grinding body 6 of the embodiment, the grinding widths grinded by the grinding pieces 16, 16, . . . respectively provided on the adjacent blades 14, 14, . . . overlap with one another by the overlap space 26. Therefore, even if the angle portions 28 and 28 of the grinding pieces 16, 16, . . . are rounded, performance thereof is not deteriorated. That is, streaks are not formed in the grinded surface and the surface is smooth.

A subject to be grinded is asphalt-mixed material in the above description, but some of pavement surfaces are made of concrete or resin-based mixed material. The pavement surface made of such material can naturally be grinded by the surface grinding device 1 of the embodiment and thereafter, the pavement surface can be repaved. In the above description, in the repairing operation of a pavement surface, it is described that a surface of the pavement surface is grinded and then, the pavement surface is repaved. However, it is not absolutely necessary to repave the pavement surface. That is, when lumps such as wheel tracks are formed on a pavement surface, the surface grinding device 1 of the embodiment smoothly grinds the lumps, and the repairing operation can be completed.

EXPLANATION OF SYMBOLS

1 surface grinding device
5 vehicle
6 grinding body
8 dust-proof cover
13 rotation shaft
14 blade
15 plate
16 grinding piece
18 shaft hole
20 notch
23 spacers
26 overlap space

SEQUENCE LISTING

Not Applicable

The invention claimed is:

1. A surface grinding device of a pavement surface for grinding a surface of the pavement surface by a rotating grinding body, wherein the grinding body comprises a rotation shaft, and a plurality of blades provided on the rotation shaft, each of the blades includes a substantially rectangular plate having a predetermined thickness, and arc grinding pieces provided on edges of both short sides of the rectangular plate, a shaft hole is formed in a center of the blade, and the rotation shaft is inserted into the shaft hole, the plurality of blades in the grinding body are deviated from and overlap with one another in a rotation direction of the grinding body such that the grinding pieces respectively provided on the adjacent blades are deviated from one another in the rotation direction, a width of the grinding piece is greater than a thickness of the plate and according to this configuration, when the grinding body rotates to grind a surface of the pavement surface, widths of the surface grinded by the grinding pieces of the adjacent blades overlap with each other by a predetermined overlap space.

2. The surface grinding device of a pavement surface according to claim 1, wherein each of the grinding pieces is formed by sintering from metal material including diamond grain.

* * * * *